United States Patent [19]

Sigg

[11] Patent Number: 4,572,442

[45] Date of Patent: Feb. 25, 1986

[54] BOWL-TYPE GRINDING APPARATUS

[75] Inventor: Hans Sigg, Mutschellen, Switzerland

[73] Assignee: Maag Gear-Wheel & Machine Company Limited, Zurich, Switzerland

[21] Appl. No.: 544,936

[22] Filed: Oct. 24, 1983

[30] Foreign Application Priority Data

Oct. 29, 1982 [CH] Switzerland ..... 6313/82

[51] Int. Cl.[4] ..... B02C 15/00

[52] U.S. Cl. ..... 241/117; 241/285 R

[58] Field of Search ..... 241/285 R, 121, 122, 241/117, 118, 119, 120, 101.2

[56] References Cited

U.S. PATENT DOCUMENTS 4,349,158 9/1982 Broman ..... 241/117 X

FOREIGN PATENT DOCUMENTS 2716025 10/1978 Fed. Rep. of Germany .

2828401 1/1979 Fed. Rep. of Germany ..... 241/117

*Primary Examiner*—Mark Rosenbaum

*Attorney, Agent, or Firm*—Werner W. Kleeman

[57] ABSTRACT

Two grinding rolls are mounted at a roll carrier. Below the roll carrier a grinding bowl is rotatably mounted on an axial thrust bearing for rotation about a substantially vertical axis. Below the axial thrust bearing there is arranged a drive device for the grinding bowl. A speed reduction gear arrangement is disposed between the drive device and the grinding bowl and contains a substantially cylindrical housing. This housing supports the axial thrust bearing and itself is supported by a substantially ring-shaped flange at a stand or framework at which there is also supported the roll carrier. The flange is connected to the roll carrier by means of a plurality of, for instance, four tie rods. Thus, the forces exerted by the grinding rolls on the grinding bowl and which are transferred therefrom to the housing and the reaction forces associated therewith are transmitted over a relatively short path via the flange to the roll carrier without loading any members of the drive device which are arranged below the flange.

9 Claims, 6 Drawing Figures

BOWL-TYPE GRINDING APPARATUS

CROSS-REFERENCE TO RELATED APPLICATIONS

This application is related to (i) the commonly assigned, copending United States application Ser. No. 06/434,914, filed Oct. 18, 1982, entitled: "GEARING ARRANGEMENT FOR A GRINDING APPARATUS, ESPECIALLY A BOWL-TYPE GRINDER"; since granted as U.S. Pat. No. 4,471,671 on Sept. 18, 1984; and (ii) the commonly assigned, copending United States application Ser. No. 06/506,317, filed June 20, 1983, entitled: "GEARING ARRANGEMENT FOR A GRINDING APPARATUS, ESPECIALLY A BOWL-TYPE GRINDER", since abandoned.

BACKGROUND OF THE INVENTION

The present invention relates to a new and improved bowl-type grinding apparatus.

In its more specific aspects, the present invention relates to a new and improved bowl-type grinding apparatus comprising a roll carrier at which there are mounted two or more grinding rolls, a grinding bowl which is mounted for rotation below the roll carrier about a substantially vertical axis on an axial thrust bearing, a drive means or arrangement for the grinding bowl arranged below the axial thrust bearing, and a speed reduction gear arrangement or gearing arranged between the drive means and the grinding bowl and comprising a substantially cylindrical housing which supports the axial thrust bearing and itself is supported by a substantially ring-shaped, outwardly protruding flange or flange member.

In a state-of-the-art bowl-type grinding apparatus of this kind as known, for example, from German Patent Publication No. 2,716,025, published Oct. 19, 1978, and specifically from FIG. 2 therein, the housing of the reduction gearing comprises a cylindrical upper housing member which is designed with a ring-shaped, outwardly protruding flange. This upper housing member is supported by means of such flange at a corresponding flange provided at the lower housing member and is secured thereto by being bolted thereat. The lower housing member rests on a base or foundation and conducts into the base the forces which are exerted by the grinding rolls on the grinding bowl and which are transmitted via the axial thrust bearing to the upper housing member. The lower housing member is thus heavily loaded during operation not only by axial forces, but also by forces acting in both the circumferential as well as in the radial direction. Such forces change with the operating conditions and as a function of the properties of the material to be ground and also cause bending moments. Therefore, deformations can not fail to occur in the lower housing member. These deformations adversely affect the speed reduction gearing as well as an angular gearing which precedes the speed reduction gearing as a component of the drive means and which is arranged in the same lower housing member as the speed reduction gearing. The tooth bearing or localized tooth contact of the gear teeth can markedly deteriorate as a consequence of the deformations appearing in the lower housing member. Additionally, also the upper housing member does not remain unaffected by the deformations appearing in the lower housing member, whereby also the bearing or load-supporting capability of the axial thrust bearing can significantly deteriorate.

SUMMARY OF THE INVENTION

Therefore, with the foregoing in mind it is a primary object of the present invention to provide an improved construction of bowl-type grinding apparatus which is not afflicted with the aforementioned drawbacks and limitations of the prior art constructions.

It is a further important object of the present invention to provide a new and improved construction of bowl-type grinding apparatus in which the forces transmitted through the axial thrust bearing, notwithstanding a relatively small constructional expenditure in the design of the housing, do not substantially affect the bearing of the gear teeth and of the axial thrust bearing.

Now in order to implement these and still further objects of the invention, which will become more readily apparent as the description proceeds, the apparatus of the present development is manifested by the features that, the flange is supported at a stand at which there is also supported the roll carrier.

As a result of this construction the forces exerted by the grinding rolls on the grinding bowl and transmitted thereby to the housing and the reaction forces associated therewith are transmitted over a relatively short distance or path via the flange or flange member to the roll carrier without loading any members of the drive means or arrangement which are arranged below the aforementioned flange.

In accordance with a preferred further development of the bowl-type grinding apparatus according to the invention the flange is connected to the roll carrier by at least two tie rods or equivalent structure. The main components of the bowl-type grinding apparatus, starting at the top with the roll carrier and ending at the bottom with the flange or flange member, are thus held together in order to form a compact unit within which the grinding forces and the related reaction forces balance each other, so that the stand or framework substantially only has to take-up loads which are caused by gravity.

In such an arrangement the flange or flange member can be supported at a shoulder of the stand or framework and the roll carrier can be guided to be vertically displaceable at the stand.

Alternatively, the flange may be suspended from the roll carrier via the tie rods and the roll carrier may be supported at a shoulder of the stand or framework.

Advantageously, the axial thrust bearing comprises in the usual manner a multitude of bearing segments or parts. In the inventive bowl-type grinding apparatus the number of tie rods preferably either amounts to one-half or one-quarter of the number of such bearing segments. In this manner there is beneficially achieved the result that the deformations at all points or locations at which the segments are supported are always of essentially the same magnitude, so that also the loads exerted on the individual bearing segments can be maintained essentially of the same magnitude.

In a preferred further development of the bowl-type grinding apparatus according to the invention, the flange contains a substantially ring-shaped support surface for the housing, which support surface has a mean diameter which at least approximately conforms with the mean diameter of the housing and with the mean diameter of the axial thrust bearing. The bending moments of the axial grinding forces occurring in the flange are thus maintained away from the housing to a large extent if not completely.

Finally, the flange or flange member of the bowl-type grinding apparatus according to the invention is preferably designed such that the speed reduction gearing can be laterally removed from the stand conjointly with the axial thrust bearing over the flange.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components and wherein.

DETAILED DESCRIPTION OF THE PREFERRED EMBODIMENTS

Figure 1:
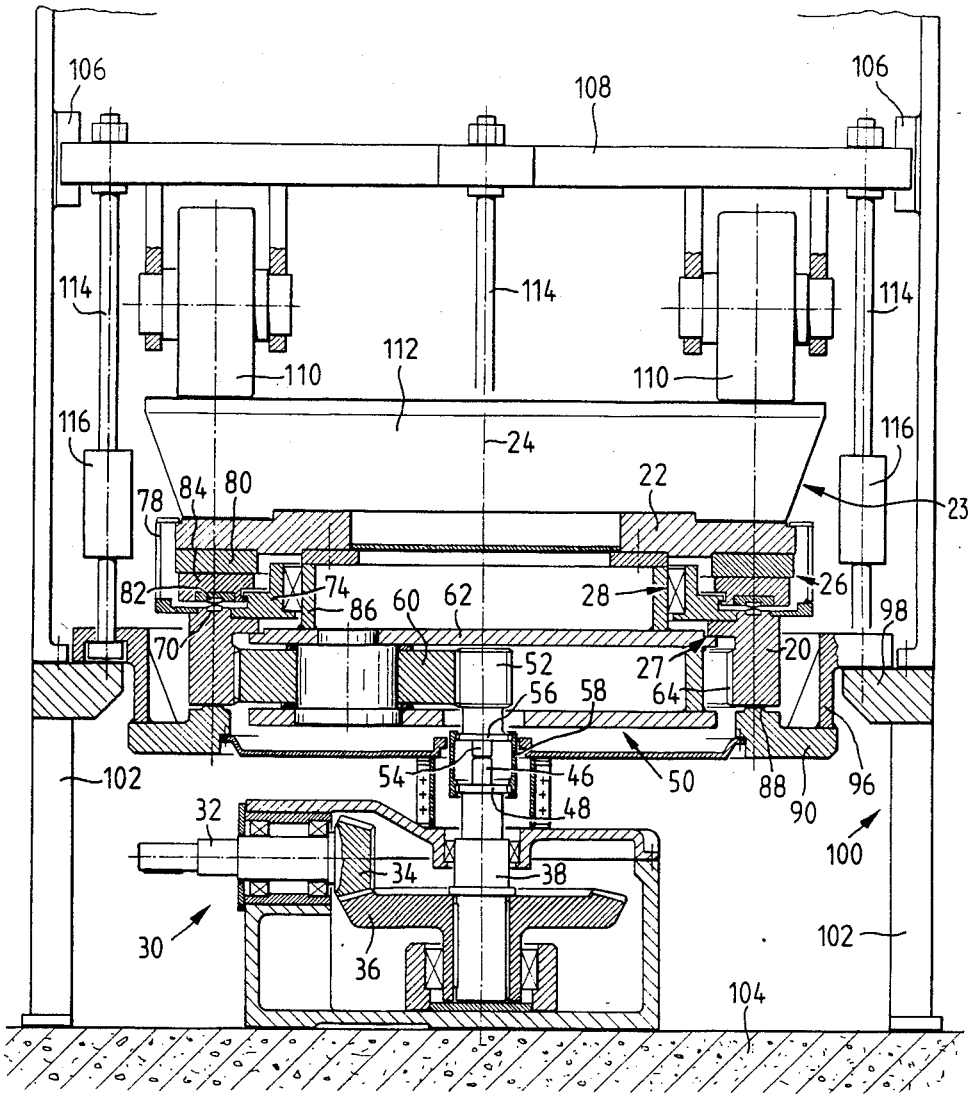
FIG. 1 is a vertically and axially sectional view of a first exemplary embodiment of bowl-type grinding apparatus constructed according to the present invention.

Describing now the drawings, it is to be understood that only enough of the construction of the bowl-type grinding apparatus or roll crushing mill to the present invention has been shown as needed for those skilled in the art to readily understand the underlying principles and concepts of the present development, while simplifying the showing of the drawings. Turning attention now specifically to FIGS. 1 to 4 of the drawings, there have been shown therein four different exemplary embodiments of the inventive bowl-type grinding apparatus or roll crushing mill in vertical and axial sectional views. All of the four embodiments illustrated in FIGS. 1 to 4 will be seen to comprise as a load-bearing member a substantially cylindrical housing 20 upon which a mounting or support plate or plate member 22 is rotatably mounted for rotational movement about a substantially vertical axis of rotation 24, by means of an axial thrust bearing 26, an axial counterthrust bearing 27, and a radial bearing 28. Below the housing or housing member 20 there are arranged drive means 30.

In the first exemplary embodiment shown in FIG. 1 the drive means or drive arrangement 30 comprises an angular or bevel gearing and a not particularly illustrated but conventional horizontally arranged electric motor. In the second, third and fourth exemplary embodiments illustrated in FIGS. 2, 3 and 4, respectively, the drive means or arrangement 30 is formed by a substantially vertically arranged multi-pole electric motor which, in the fourth embodiment shown in FIG. 4, comprises an associated speed reduction gearing 31 directly mounted thereat.

The drive means or arrangement 30 as illustrated in FIG. 1 comprises an angular gearing arrangement which is constituted by bevel gearing or gears. Belonging to the angular gearing arrangement is a substantially horizontal drive shaft 32 provided with a bevel pinion 34 constructed or mounted thereat. This bevel pinion 34 meshes with a substantially dished or dish-shaped bevel gear 36 affixed to a substantially vertical power take-off shaft 38 which is essentially coaxially arranged with respect to the rotational axis 24. At the upper end of the power take-off shaft 38 there is formed or secured a support pin or pin member 46 which is crowned or domed at its top or upper region as well as outer or externally-toothed clutch teeth or teeth arrangement 48. The drive means 30 in the second, third and fourth embodiments of the bowl-type grinding apparatus are correspondingly structured.

The housing or housing member 20 forms a component of a speed reduction gear arrangement or gearing 50 which may be structured as a planetary gearing arrangement or planetary gearing. Belonging to the planetary gearing 50 is a sun gear 52 which is arranged essentially coaxially with respect to the vertical axis of rotation 24. The sun gear 52 is provided with a downwardly protruding support pin 54 which is substantially planar at its lower or bottom face and bears upon the crowned upper surface or face of the support pin 46. The support pin or pin member 54 also has operatively associated therewith an outer or externally-toothed clutch tooth arrangement or clutch teeth 56 which is connected with the clutch teeth or clutch tooth arrangement 48 by an internally-toothed clutch or coupling socket or sleeve 58. The clutch socket 58 downwardly bears, against axial displacement, at the clutch teeth 48 of the power take-off shaft 38.

The sun gear 52 meshes with three planetary gears 60 which are mounted at a substantially equidistant angular spacing at a planetary gear support or carrier member 62 which may be in the form of a support or carrier plate. All of the planetary gears 60, of which only one has been particularly illustrated, mesh with internal gear teeth 64 which are formed directly at the housing 20.

At the upper end face or top surface of the housing or housing member 20 there is embedded a lower support ring or ring member 70. Inwardly thereof there is supported and centered a holder ring or ring member 74 at the housing 20. The holder ring or ring member 74, in turn, supports and centers the radial bearing 28. At the housing 20 there is further supported and centered a sealing collar or rim member 78 which exerts a sealing action in the direction of the mounting or support plate 22.

Also belonging to the axial thrust bearing 26 is an upper bearing ring or ring member 80 which is affixed to the mounting or support plate 22 as well as a rim formed by upper bearing segments 82 which tiltably or rockably bear upon the lower support ring member 70 and into each one of which there is embedded a bearing segment 84. The bearing ring or ring member 80 slidingly bears upon the bearing segments 84.

At the underside of the support or mounting plate member 22 there is additionally attached, such as by bolting, a bearing rim member 86 which is mounted at the radial bearing 28 and at which there is attached the planetary gear support or carrier member 62.

The housing or housing member 20 bears upon a substantially ring-shaped or annular support surface or member 88 which is formed at the top side or upper region of a radially outwardly protruding, substantially ring-shaped flange or flange member 90. The ring-shaped support surface 88 has a mean diameter which essentially coincides with the mean diameter of the housing 20 and with the mean diameter of the axial thrust bearing 26.

Figure 2:
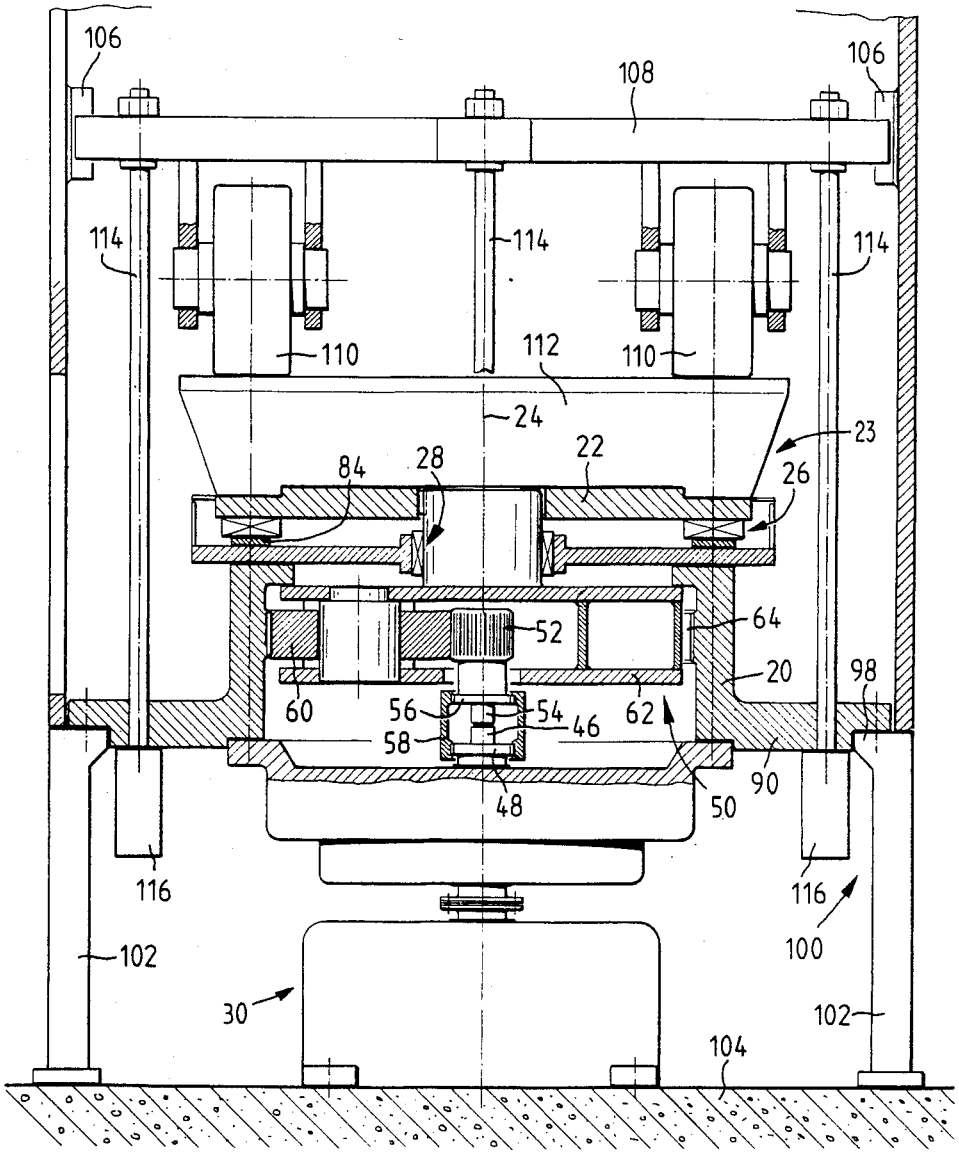
FIG. 2 is a vertically and axially sectional view of a second exemplary embodiment of bowl-type grinding apparatus constructed according to the present invention.
Figure 3:
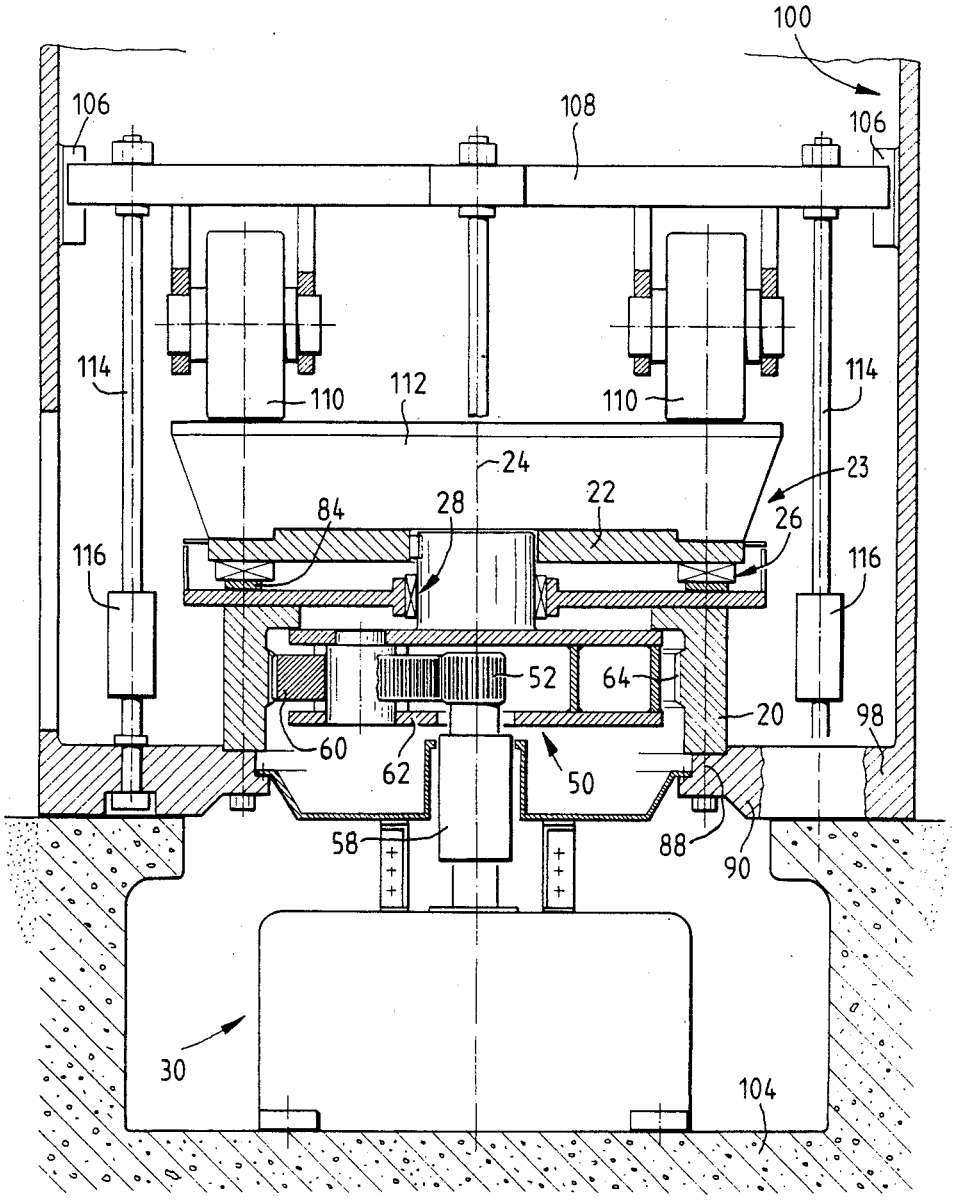
FIG. 3 is a vertically and axially sectional view of a third exemplary embodiment of bowl-type grinding apparatus constructed according to the present invention.
Figure 4:
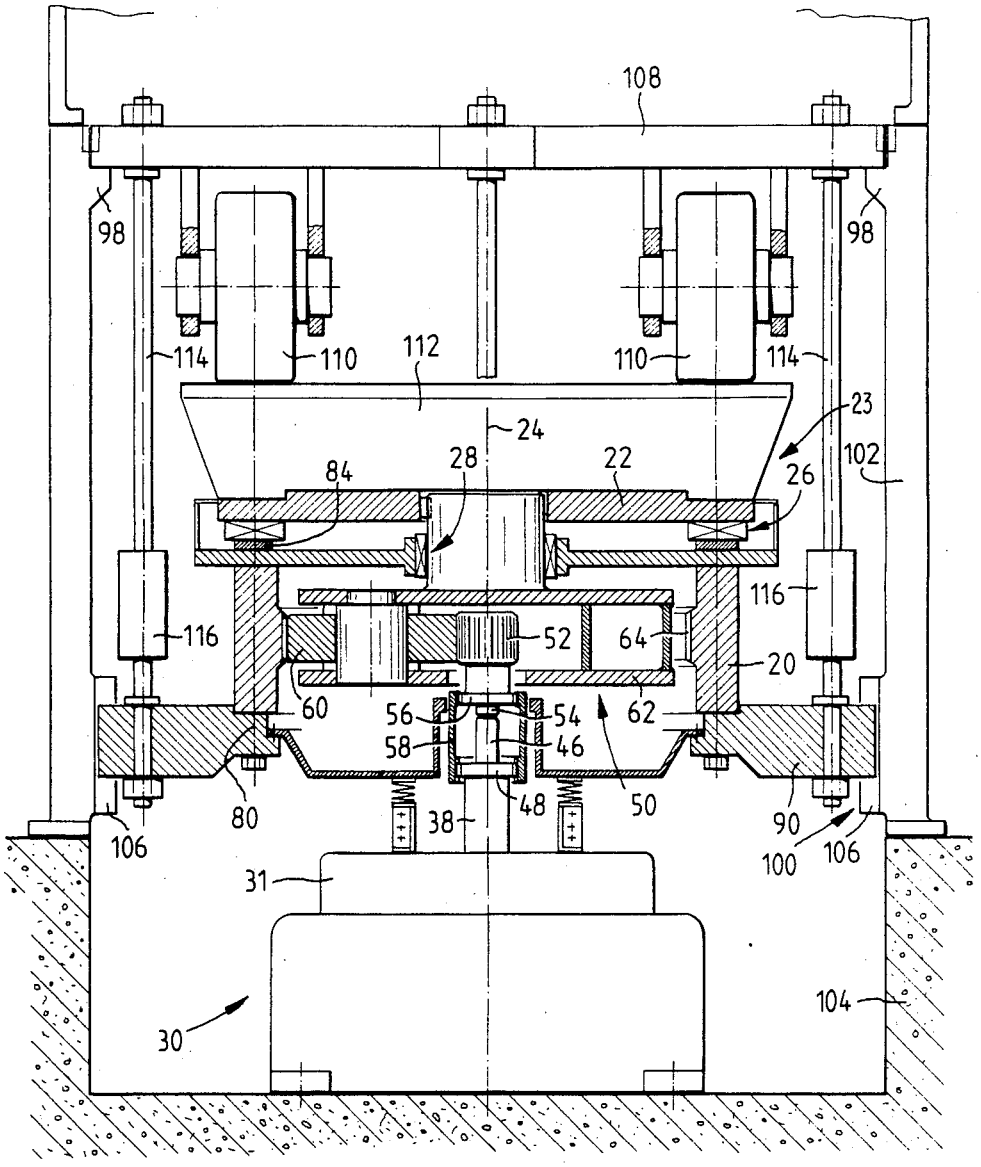
FIG. 4 is a vertically and axially sectional view of a fourth exemplary embodiment of bowl-type grinding apparatus constructed according to the present invention.

In the first exemplary embodiment as illustrated by FIG. 1 of the drawings the flange or flanges meber 90 is supported by means of a substantially ring-shaped insert 96 mounted to the flange 90 at a shoulder 98 or equivalent structure formed in a stand or framework 100. In the second exemplary embodiment of the bowl-type grinding apparatus as illustrated by FIG. 2 of the drawings, the flange or flange member 90 is correspondingly designed, however, here formed integrally with the housing 20. In the third exemplary embodiment of the bowl-type grinding apparatus according to the invention as shown in FIG. 3 of the drawings, the substantially ring-shaped flange or flange member 90 is formed integrally with the shoulder 98 of the stand or framework 100. In the fourth exemplary embodiment of the bowl-type grinding apparatus according to the invention as shown in FIG. 4 of the drawings, the substantially ring-shaped flange or flange member 90 is suspended from the shoulder 98 which is arranged at a correspondingly higher level at the stand or framework 100.

In the first and second exemplary embodiments of the bowl-type grinding apparatus as illustrated in FIGS. 1 and 2, the stand or framework 100 may comprise two uprights or columns 102 which bear upon a base or foundation 104 and which either form or carry the shoulder or shoulder member 98 or equivalent structure.

In all of the illustrated embodiments there are formed or provided at the stand 100 four substantially vertical guiding means or guide members 106 which are mutually offset by an angular distance of 90°. In the first, second and third embodiments as respectively shown in FIGS. 1, 2 and 3, a cross-shaped roll carrier or support member 108 is vertically displaceably guided at the guiding means or guide members 106 and is simultaneously appropriately secured against rotating about the rotational axis 24. A number of grinding or milling rolls 110 are mounted at the roll carrier 108. Two such grinding rolls 110 are provided, by way of example and not limitation, in the illustrated embodiments. The grinding rolls 110 are structured to roll upon a grinding bowl or milling pan 112 or the like which is supported and centered at the mounting or support plate or plate member 22. The grinding rolls 110 and the grinding bowl 112 are commonly rotatable about the vertical rotational axis 24. The grinding bowl 112, the support plate 22 and the axial thrust bearing 26 form the principal components of a milling platen or table 23.

The roll carrier or support member 108 is connected to the ring-shaped flange or flange member 90 by a number of connecting members, here tie rods 114 which are equally spaced around the vertical rotational axis 24 and extend substantially parallel thereto. In the illustrated embodiments four such tie rods 114 or equivalent connecting facilities are provided. Each tie rod 114 comprises a tightening device or facility 116 and the latter are adjusted such that they participate as uniformly as possible in the transmission of reaction forces which result from the axial forces exerted by the grinding rolls 110 upon the grinding bowl 112 during operation of the bowl-type grinding apparatus.

In the first, second and third exemplary embodiments of the bowl-type grinding apparatus according to the invention as shown in FIGS. 1, 2 and 3, respectively, the load on the tie rods 114 corresponds to the aforementioned reaction forces reduced by the weight of the roll carrier or carrier member 108 including the grinding rolls 110. In the fourth exemplary embodiment as illustrated in FIG. 4, however, the ring-shaped flange 90 is suspended from the shoulder 98 by means of the tie rods 114 and the roll carrier 108. Consequently, in this embodiment the tie rods 114 have to transmit the weight of the ring-shaped flange 90 and that of all the members of the bowl-type grinding apparatus supported thereby in addition to the aforementioned reaction forces. In all the embodiments the stand or framework 100 is not loaded by the axial grinding forces and the associated reaction forces, since such forces are mutually balanced or neutralized via the tie rods 114 along the shortest possible path.

Figure 5:
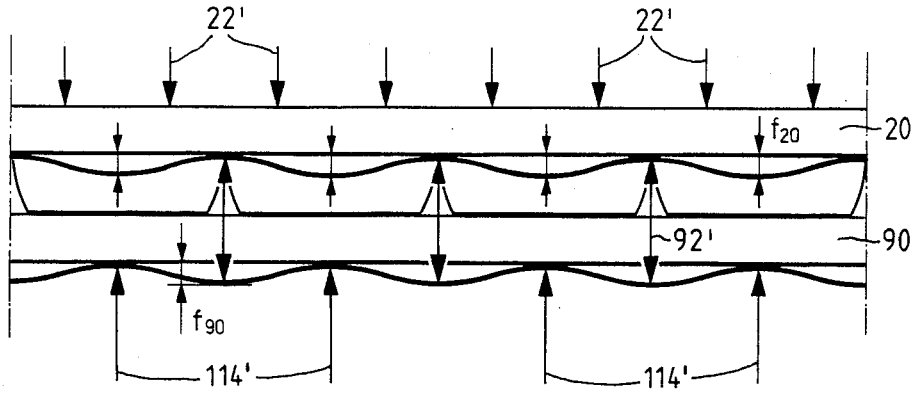
FIG. 5 shows a partial development of a deformation diagram due to axial forces according to a first modification of the embodiments of FIGS. 1 through 4.

In FIG. 5 there is shown in a simplified manner one-half of a development view of the axial thrust bearing 26 of a modified embodiment of a bowl-type grinding apparatus constructed according to the present invention. In this embodiment four tie rods 114 are provided and the housing 20 is supported at eight bearing segments 84, so that the number of bearing segments 84 amounts to twice the number of tie rods 114. In such a design the forces which are exerted by the tie rods 114 on the ring-shaped flange 90 are each designated by a pair of arrows 114'. The forces reacting back on the housing 20 from the flange 90 are designated by reference character 92'. The forces acting upon the housing 20 from the mounting or support plate 22 are indicated by the arrows 22'. At the housing 20 there occur deflections or flexures designated $f_{20}$ at the bearing or support locations of the bearing segments 84 and in such an arrangement such deflections or flexures $f_{20}$ are of equal size or magnitude independent of the total load at all the bearing or supporting locations, and thus, also at all bearing segments 84. Corresponding conditions also hold true for the deflection or flexure $f_{90}$ of the ring-shaped flange or flange member or flange member 90.

Figure 6:
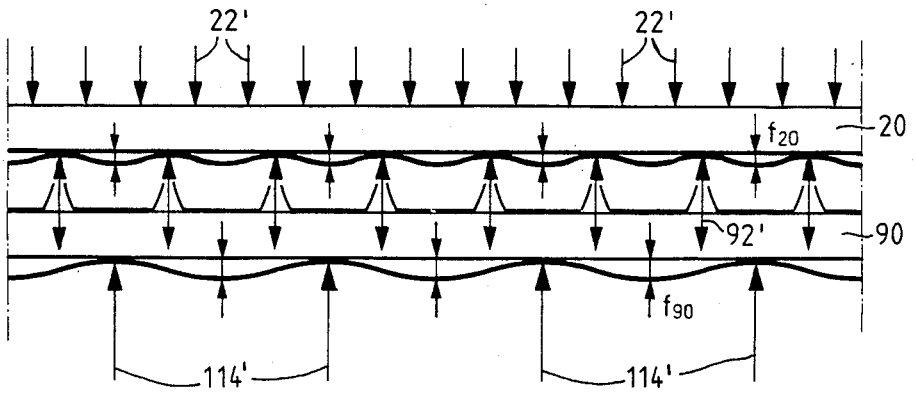
FIG. 6 shows a partial development of a deformation diagram due to axial forces according to a second modification of the embodiment of FIGS. 1 through 4.

For comparison there is shown in FIG. 6 a development of one-quarter of the axial thrust bearing 26 of a further modified embodiment of the bowl-type grinding apparatus according to the present invention. There are also shown the deflections or flexures $f_{20}$ and $f_{90}$ which result under equal load on the bowl-type grinding apparatus when the housing 20 is supported at sixteen bearing segments 84, the number of tie rods 114 again being four.

While there are shown and described present preferred embodiments of the invention, it is to be distinctly understood that the invention is not limited thereto, but may be otherwise variously embodied and practiced within the scope of the following claims. Accordingly,

What I claim is:

1. A bowl-type grinding apparatus comprising:

a roll carrier;

at least two milling rolls journalled in said roll carrier;

a milling platen arranged below said roll carrier and including a grinding bowl and an axial thrust bearing defining a substantially vertical axis;

said axial thrust bearing supporting said milling platen;

drive means including speed reduction gearing;

said drive means and said speed reduction gearing thereof being conjointly mounted below said axial thrust bearing;

a flange;

a framework supporting said flange;

said milling platen bearing upon said framework through said flange;

said speed reduction gearing being arranged within said milling platen;

a housing for said speed reduction gearing;

said axial thrust bearing having a predetermined region for transmitting axial force;

said housing being arranged substantially in line with said predetermined region and connected to said flange of said milling platen such that axial forces generated by said at least two milling rolls and transmitted through said milling platen, said axial thrust bearing and said housing follow a substantially straight line;

at least two tie rods interconnecting said flange and said roll carrier for conducting said forces back to said roll carrier and ultimately said framework; and said roll carrier being supported on said framework.

2. The bowl-type grinding apparatus as defined in claim 1, wherein:

a shoulder is provided for said stand;

said flange member being supported at said shoulder; and said roll carrier being guided at said stand for substantially vertical displacement.

3. The bowl-type grinding apparatus as defined in claim 1, wherein:

a shoulder is provided for said stand; and said flange member being suspended from said roll carrier via said tie rods and being supported at said shoulder.

4. The bowl-type grinding apparatus as defined in claim 1, wherein:

said axial thrust bearing comprises a multitude of bearing segments; and said at least two tie rods being present in a number which amounts to one-half of the number of said bearing segments.

5. The bowl-type grinding apparatus as defined in claim 1, wherein:

said axial thrust bearing comprises a multitude of bearing segments; and said at least two tie rods being present in a number which amounts to one-quarter of the number of said bearing segments.

6. The bowl-type grinding apparatus as defined in claim 1, wherein:

said flange member possesses a substantially ring-shaped support surface supporting said housing;

said support surface, said axial thrust bearing and said housing each defining a mean diameter; and said mean diameter of said support surface at least approximately coinciding with said mean diameters of said housing and said axial thrust bearing.

7. The bowl-type grinding apparatus as defined in claim 6, wherein:

said flange member is structured such that said speed reduction gearing is laterally removable from said stand conjointly with said axial thrust bearing over said flange member.

8. The bowl-type grinding apparatus as defined in claim 6, wherein:

said flange member is integrally formed with said stand.

9. The bowl-type grinding apparatus as defined in claim 1, wherein:

said flange member is integrally formed with said housing.

* * * * *

UNITED STATES PATENT AND TRADEMARK OFFICE

CERTIFICATE OF CORRECTION

PATENT NO. : 4,572,442

DATED : February 25, 1986

INVENTOR(S) : HANS SIGG

It is certified that error appears in the above—identified patent and that said Letters Patent is hereby corrected as shown below:

Column 3, line 44, after "mill" please insert --according--

Column 5, line 13, please delete "flanges meber" and insert --flange member--

Signed and Sealed this

*Eighth* Day of *July 1986*

[SEAL]

*Attest:*

DONALD J. QUIGG

*Attesting Officer*

*Commissioner of Patents and Trademarks*